US006647892B2

(12) United States Patent
Theurer et al.

(10) Patent No.: US 6,647,892 B2
(45) Date of Patent: Nov. 18, 2003

(54) MACHINE FOR TREATING A TRACK

(75) Inventors: Josef Theurer, Vienna (AT); Manfred Brunninger, Altenberg (AT)

(73) Assignee: Franz Plasser Bahnbaumaschinen-Industriegesellshaft m.b.H., Vienna (AT)

( * ) Notice: Subject to any disclaimer, the term of this patent is extended or adjusted under 35 U.S.C. 154(b) by 0 days.

(21) Appl. No.: 10/214,662

(22) Filed: Aug. 8, 2002

(65) Prior Publication Data

US 2003/0037694 A1 Feb. 27, 2003

(30) Foreign Application Priority Data

Aug. 24, 2001 (AT) ..... 1349/2001

(51) Int. Cl.[7] ..... E01B 27/17

(52) U.S. Cl. ..... 104/7.1

(58) Field of Search ..... 104/2, 7.1, 7.2, 104/10, 12

(56) References Cited

U.S. PATENT DOCUMENTS 4,893,565 A * 1/1990 Theurer et al. ..... 104/7.2

* cited by examiner

*Primary Examiner*—S. Joseph Morano
*Assistant Examiner*—Robert J. McCarry, Jr.
(74) *Attorney, Agent, or Firm*—Henry M. Feiereisen

(57) ABSTRACT

A track working machine includes a track-bound machine frame and a working unit mounted on the machine frame. A track lifting unit is vertically adjustably mounted on the machine frame and includes a tool frame, lifting drives connecting the tool frame for vertical adjustment to the machine frame, and flanged rollers for supporting the tool frame on each rail of the track. Two pairs of lifting rollers are mounted on the tool frame in the region of each rail, and spaced apart in longitudinal direction. Each pair has a transverse adjustment drive for squeezing the lifting rollers together transversely to the longitudinal direction, and a vertical adjustment drive for independent vertical adjustment of the lifting rollers relative to the tool frame. Distancing of the lifting rollers of each pair is coupled to automatic actuation of the associated adjustment drive for lowering the lifting rollers relative to the tool frame.

13 Claims, 2 Drawing Sheets

Fig. 1
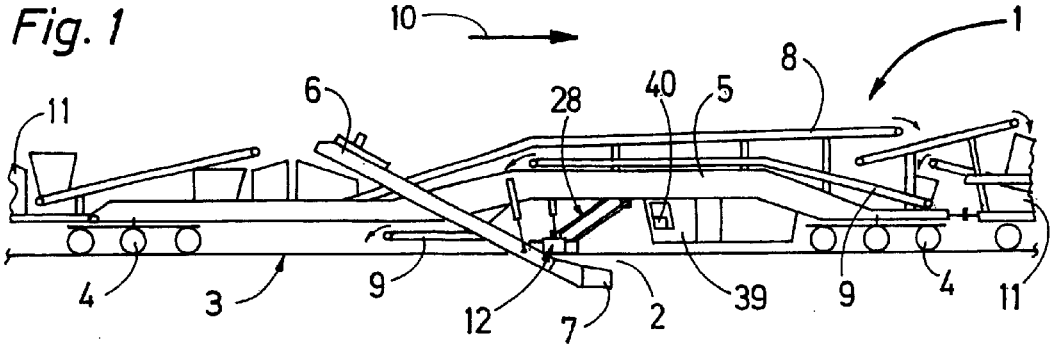
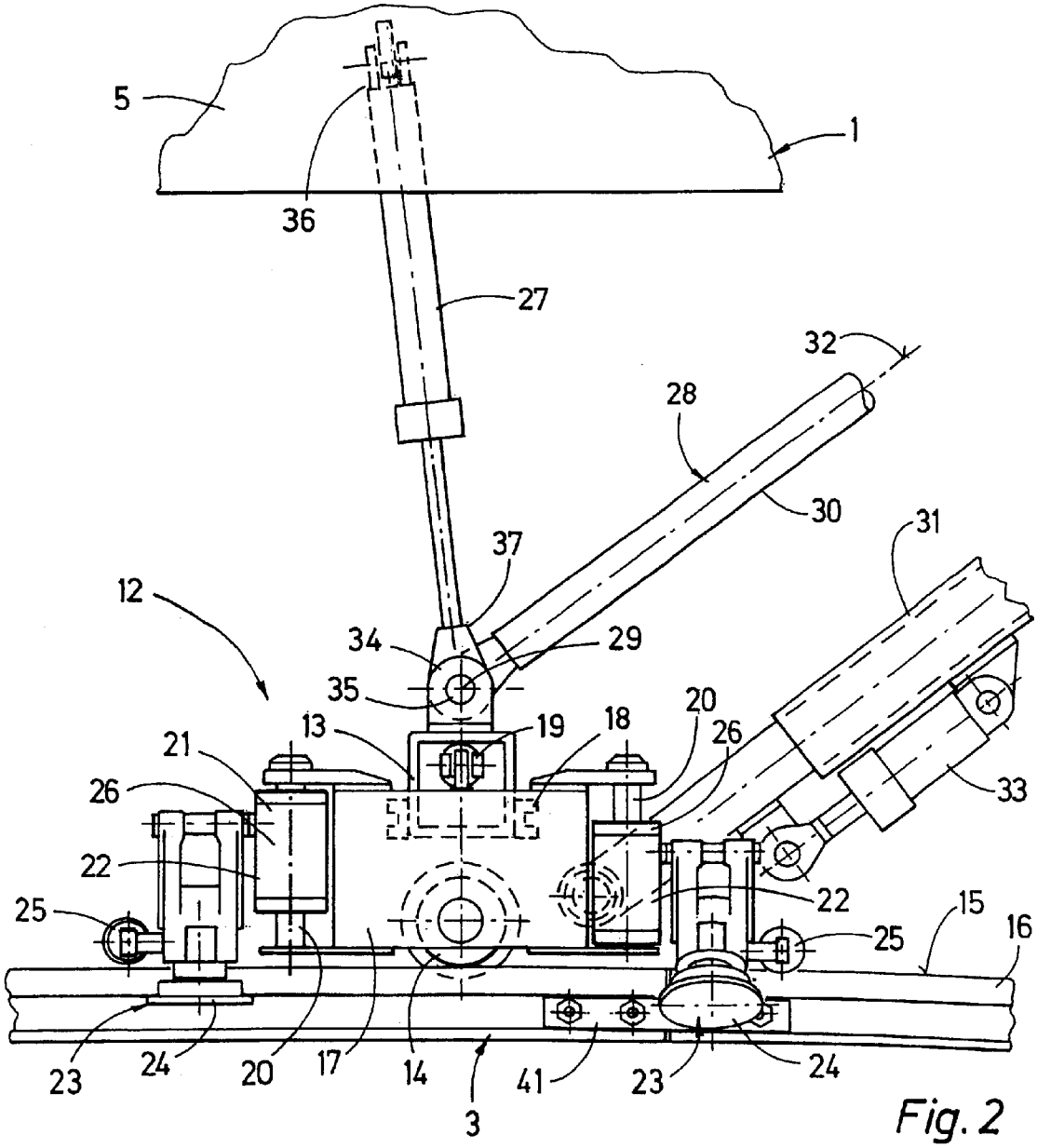
Fig. 2

MACHINE FOR TREATING A TRACK

CROSS-REFERENCES TO RELATED APPLICATIONS

This application claims the priority of Austrian patent application No. A 1349/2001, filed Aug. 24, 2001, the subject matter of which is incorporated herein by reference.

BACKGROUND OF THE INVENTION

The present invention relates, in general, to a machine for treating a track extending in a longitudinal direction and comprised of two rails fastened to ties supported on ballast, and more particularly to a machine comprising a machine frame supported for mobility on the track by undercarriages, a working unit mounted on the machine frame, and a track lifting unit vertically adjustably mounted on the machine frame, wherein the track lifting unit comprises a tool frame, lifting drives connecting the tool frame for vertical adjustment to the machine frame, flanged rollers for supporting the tool frame on each rail of the track, respectively, and two pairs of lifting rollers, mounted on the tool frame in the region of each rail, respectively, and spaced from one another in the longitudinal direction, each pair having a transverse adjustment drive for squeezing the two lifting rollers together transversely to the longitudinal direction.

The pairs of lifting rollers, acting pincer-like, are in form-fitting engagement with the rail head and roll on the underside thereof, thus enabling a continuous forward working movement of the machine during working operations. In the event of encountering obstacles or very irregular rail shapes, the two pairs of lifting rollers, positioned one following the other in the longitudinal direction, are opened one after the other and closed again after passing the problem area, thus ensuring continual engagement of the rail by at least one roller pair without interruption.

U.S. Pat. No. 4,893,565 discloses a machine which includes gripping members designed for vertical adjustment by means of a drive, thus affording the possibility of bringing gripping hooks into engagement with the rail head or, optionally, also with the rail base of the rails of the track to be lifted.

It would be desirable and advantageous to provide an improved machine of the afore-described type with which it is possible to surmount, in an easier and safer manner, regions in the track which may include areas with variations of the rail cross-section.

SUMMARY OF THE INVENTION

According to one aspect of the present invention, a machine is provided for treating a track extending in a longitudinal direction and comprised of two rails fastened to ties supported on ballast, the machine comprising a machine frame supported for mobility on the track by undercarriages; a working unit mounted on the machine frame; and a track lifting unit vertically adjustably mounted on the machine frame. The track lifting unit comprises a tool frame; lifting drives connecting the tool frame for vertical adjustment to the machine frame; flanged rollers for supporting the tool frame on each rail of the track, respectively; and two pairs of lifting rollers, mounted on the tool frame in the region of each rail, respectively, and spaced from one another in the longitudinal direction, each pair having a transverse adjustment drive for squeezing the two lifting rollers together transversely to the longitudinal direction, and a respective vertical adjustment drive for independent vertical adjustment of each pair of lifting rollers with respect to the tool frame. A spacing-apart motion of the two lifting rollers of each pair by the transverse adjustment drive is coupled to an automatic actuation of the associated vertical adjustment drive for lowering the pair of lifting rollers with respect to the tool frame.

A machine including a track lifting unit designed in this way has the advantage that the lifting rollers of a pair, temporarily spaced from one another for passing over a rail obstacle or in the event of a change in rail cross-section, can be closed again or squeezed towards one another safely and without problems immediately after passing this problem area or spot. This is of significance particularly in the case of a greater lift of the track grid, since in this case, when opening the clamp formed by the lifting roller pairs, there is an unavoidable dropping of the track grid due to its own weight, and thus a change in the rail deflection curve. This vertical shifting of the track or of the rails to be gripped is, according to the invention, compensated in a simple and highly reliable manner by the automatic lowering of the lifting rollers, so that the lifting rollers are immediately situated in the correct position again with regard to the rail head to be gripped. Since the particular attention of the operator of the machine is not required in this process due to the fact that this adjustment motion is carried out automatically, it is thus possible to avoid also any diversion and any eventual infringement of safety during working operations that might result therefrom.

According to another aspect of the invention, an actuation of the transverse adjustment drive for squeezing together both lifting rollers of a pair is coupled to an automatic actuation of the associated vertical adjustment drive for lifting the pair of lifting rollers with respect to the tool frame.

This has the advantage that, after the squeezing together of the pairs of lifting rollers behind the obstacle area, the track grid is automatically lifted back up into the previously occupied position, thus ensuring smooth and uninterrupted working progress.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 is a schematic side elevational view of a machine according to the present invention for treating a track, having a track lifting unit;

FIG. 2 is an enlarged side elevational view of the track lifting unit;

DETAILED DESCRIPTION OF PREFERRED EMBODIMENTS

Figure 3:
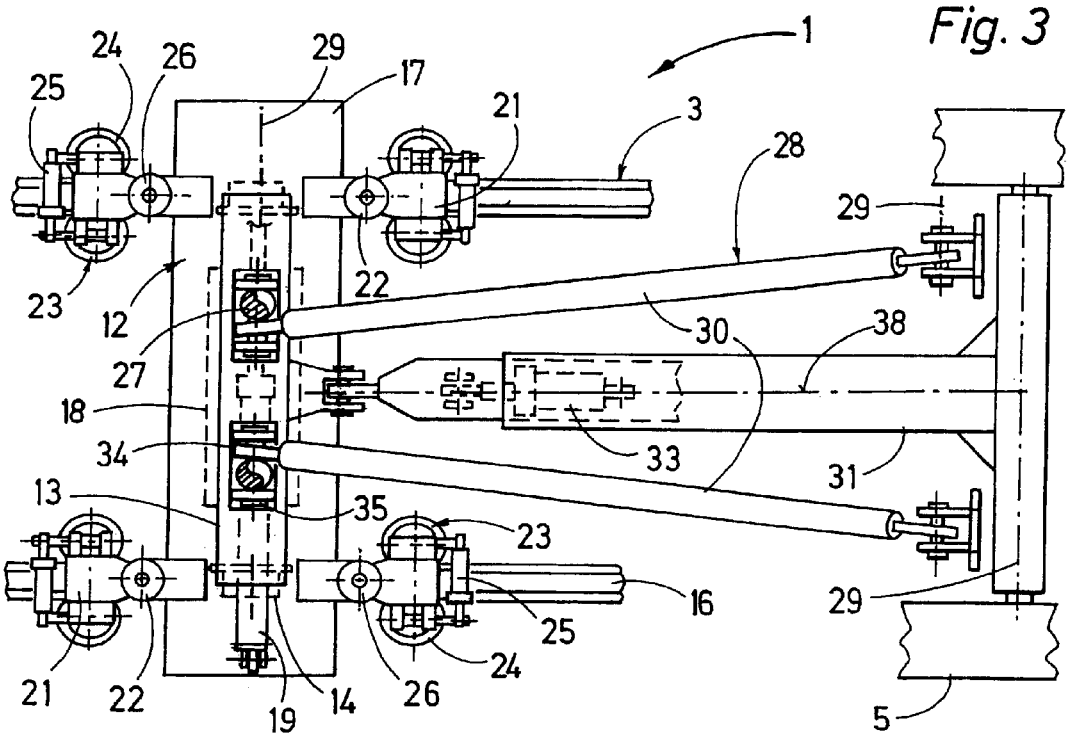
FIG. 3 is an enlarged top view of the track lifting unit.

Throughout all the Figures, same or corresponding elements are generally indicated by same reference numerals.

Turning now to the drawing, and in particular to FIG. 1, there is shown a machine 1 designed for treating a ballast bed 2 of a track 3. The machine comprises a machine frame 5 supported by undercarriages 4 on rails 16 of the track 3. A working unit 6 in the shape of a rotatable excavating chain 7, guided through underneath the track 3, for excavating the ballast bed 2 is supported on the machine frame 5. Associated with the excavating, chain 7 are conveyor belts 8 for transporting away the taken-up ballast. Additional conveyor belts 9 are provided for reintroducing cleaned ballast or new ballast at a point situated behind the excavating chain 7 in the operating direction of the machine 1, the said operating direction being indicated by an arrow 10. Additional machines 11, not shown in detail, are coupled to the machine 1 at the two ends of the machine frame 5.

A track lifting unit 12 is fastened to the machine frame 5 in the region of the excavating chain 7. The structure of the track lifting unit 12 will become more clearly apparent in further sequence also with reference to FIGS. 2, 3 and 4. The track lifting unit 12 comprises a tool frame 13 extending approximately horizontally and transversely to the longitudinal direction. Supported on the tool frame 13 is a sliding beam 17 which is designed for adjustment transversely to the longitudinal direction relative to the tool frame 13 by means of a transverse guide 18 and, for that purpose, is connected to a displacement drive 19. In the operating position (shown here), the track lifting unit 12 rests by means of flanged rollers 14 on running surfaces 15 of the rails 16, thus rolling on the same.

Figure 4:
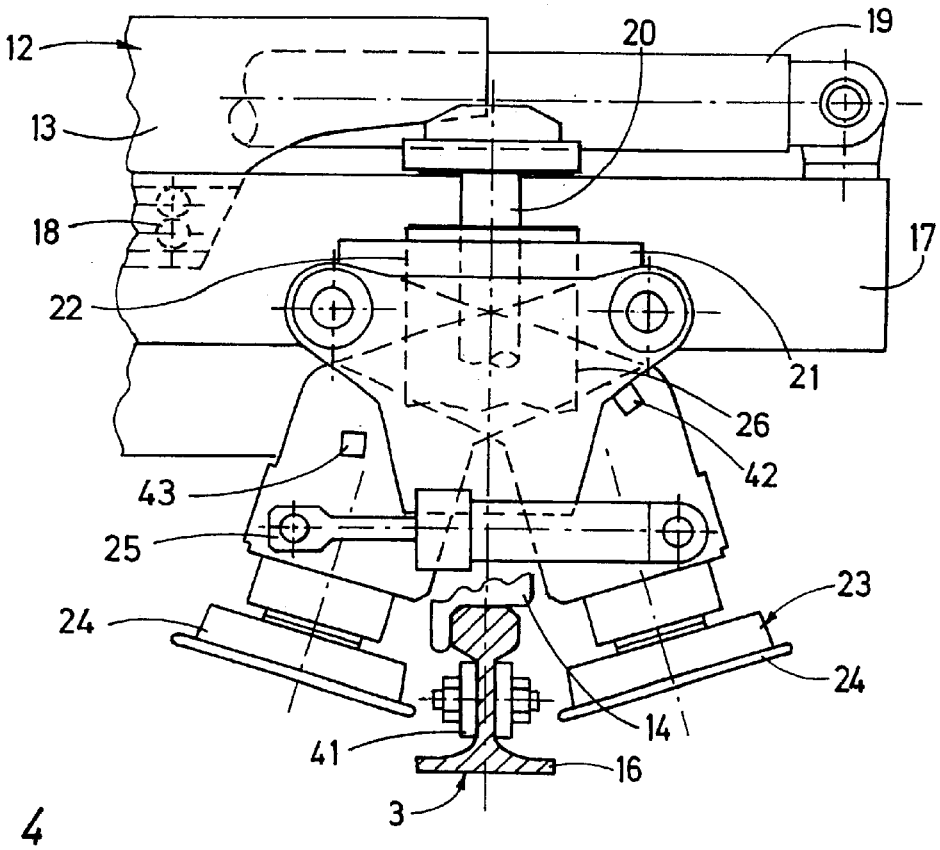
FIG. 4 is a magnified partial view of the track lifting unit in the longitudinal direction.

As shown now in more detail in FIGS. 2, 3 and 4, the sliding beam 17 comprises in the region of each rail 16 two vertical guide columns 20, spaced from one another in the longitudinal direction, on which in each case a roller carrier 21 designed as a hydraulic cylinder 22 is supported for hydraulic vertical adjustment. (As an alternative embodiment, it would also be conceivable that the guide column 20 is formed by the piston of the hydraulic cylinder 22, which would then be connected directly to the sliding beam 17). Fastened to each vertically adjustable roller carrier 21 are two lifting rollers 24—forming a pair 23—which are squeezable towards one another transversely to the longitudinal direction by means of a transverse adjustment drive 25. Thus, two pairs 23, spaced from one another in the longitudinal direction, of lifting rollers 24 which are form-fittingly applicable to a rail 16 are arranged on the sliding beam 17 per rail 16 of the track 3, these pairs 23 being designed for vertical adjustment in each case independently of each other with regard to the tool frame 13 by means of a vertical adjustment drive 26 formed by the hydraulic cylinder 22.

Housed in an operator's cabin 39 is a control device 40 (FIG. 1) which is connected to the transverse adjustment drives 25 and vertical adjustment drives 26 of the lifting rollers 24. As will be described in more detail below, these drives 25, 26 are controlled in such a way that a spacing-apart motion of the two lifting rollers 24 of a pair 23, positioned adjacent one another transversely to the longitudinal direction, is coupled to an automatic actuation of the associated vertical adjustment drive 26 in order to lower the lifting rollers 24 of said pair 23 with respect to the tool frame 13. Further, it is possible to couple, via the control device 40, an actuation of the transverse adjustment drive 25, moving the two lifting rollers 24 of a pair 23 towards one another, to an automatic actuation of the associated vertical adjustment drive 26 for lifting both lifting rollers 24 with respect to the tool frame 13.

The track lifting unit 12, or the tool frame 13, is connected to the machine frame 5 for vertical adjustment by means of two lifting drives 27, extending parallel to one another and approximately vertically and spaced from one another transversely to the longitudinal direction. In addition, by means of a linkage 28, the tool frame 13 is articulatedly connected to the machine frame 5 for pivoting about horizontal pivot axes 29 extending transversely to the longitudinal direction. This linkage 28—shaped approximately like a parallelogram when seen in side view—is composed of two tie rods 30 and a towing rod 31, the latter being designed pole-like or T-shaped. The two tie rods 30, spaced from one another transversely of the longitudinal direction, extend in a common plane 32 while the towing rod 31 extends parallel to said plane 32 but at a distance below the same. The towing rod 31 is designed to be telescopically extensible and equipped with a length adjustment drive 33.

The tie rods 30 are articulatedly fastened to the upper side of the tool frame 13 at a respective hinging point 34 which is formed in each case by a shaft 35, extending transversely to the longitudinal direction and serving as a pivot axis 29. The lifting drives 27, which are mounted at their upper ends 36 to the machine frame 5, are also articulatedly fastened at their lower ends 37 to the horizontal shaft 35 in each case immediately adjacent to the tie rod 30. As can be seen in FIG. 3, the two tie rods 30 are arranged in mirror symmetry with regard to a vertical longitudinal plane of symmetry 38 of the machine 1 and extend at an acute angle towards one another.

In working operations of the machine 1 for treating a ballast bed 2, the track lifting unit 12 is at first lowered by means of the lifting drives 27 and supported on the rails 16 of the track 3 via the flanged rollers 14. Thereafter, the pairs 23 of lifting rollers 24 are brought into form-fitting engagement with the rails 16 with the aid of the transverse adjustment drives 25 and also the vertical adjustment drives 26, after which the track 3 can be lifted by again actuating the lifting drives 27 in order to create the required working space underneath the track for employing the working unit 6 or the excavating chain 7.

For facilitating the establishing of a form-fitting contact of the lifting rollers 24 with the rails 16, the length adjustment drive 33 of the telescopic towing rod 31 is switched to zero pressure or in floating position, thus permitting an adjustment of the track lifting unit 12 to the longitudinal position of the track. During this, the tool frame 13 is able to rotate about the pivot axis 29 formed by the shafts 35 (FIG. 2) due to the fact that both the tie rods 30 and the lower ends 37 of the lifting drives 27 are articulatedly connected to the shaft 35 in the same axis 29. After the adjustment of the position in the longitudinal direction of the track has been accomplished and the lifting rollers 24 have been applied to the rails 16, the length adjustment drive 33 of the towing rod 31 is locked in order to stabilize the track lifting unit 12 in the longitudinal direction, and to keep it securely in that position.

When the track lifting unit 12, rolling continuously on the track 3 during working operations, encounters an obstacle, such as shown, for example, in FIGS. 2 and 4 in the shape of a fish-plate 41, it is necessary to temporarily distance the lifting rollers 24 from one another transversely to the longitudinal direction, and to close them again after passing the obstacle. During regular working operations, the lifting rollers 24 of each pair 23 are normally pressed together with a certain pressure. As soon as this pressure is now inevitably increased as a result of striking an obstacle, a spreading-apart motion of the two lifting rollers 24 of the pair 23 in question by means of the transverse adjustment drive 25 is automatically triggered by the control device 40. When the fully opened position of the pair 23 of lifting rollers 24 has been reached, a stop 42 (FIG. 4) is actuated which triggers an actuation of the vertical adjustment drive 26 for automatically lowering the pair 23 of lifting rollers 24.

In further sequence, the control device 40 causes, for instance by means of a timing element in connection with the speed of advance of the machine 1, that the lifting rollers 24 are automatically pivoted back together again after passing the problem area in the track 3 in order to engage the rail 16 anew.

As a result of the lowering motion coupled to the spreading motion of the lifting rollers 24, it is also ensured that the rail 16, after the fish-plate 41 has been passed over, can immediately and without loss of time be engaged again securely by squeezing together the opened pair 23 of lifting rollers 24. For safety reasons, the trailing, second pair 23 of lifting rollers 24 can only be opened if the leading pair 23 has first been closed.

With the pivoting together of the lifting rollers 24 by means of the transverse adjustment drive 25, a further stop 43 is actuated (FIG. 4). The latter causes, via the control device 40, that, along with the actuation of the transverse adjustment drive 25 for applying the two lifting rollers 24 of the lowered pair 23 to the rail 16 behind the obstacle, an automatic actuation of the associated vertical adjustment drive 26 is also triggered in order to lift the two lifting rollers 24—and thereby the track 3—into the original position relative to the tool frame 13 again, and to ensure an uninterrupted continuation of the continuous working operation of the machine 1.

While the invention has been illustrated and described as embodied in a machine for treating a track, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A machine for treating a track extending in a longitudinal direction and comprised of two rails fastened to ties supported on ballast, comprising a) a machine frame supported for mobility on the track by undercarriages;

b) a working unit mounted on the machine frame; and c) a track lifting unit vertically adjustably mounted on the machine frame and comprising 1) a tool frame;

2) lifting drives connecting the tool frame for vertical adjustment to the machine frame;

3) flanged rollers for supporting the tool frame on each rail of the track, respectively;

4) two pairs of lifting rollers, mounted on the tool frame in the region of each rail, respectively, and spaced from one another in the longitudinal direction, each pair having a transverse adjustment drive for squeezing the two lifting rollers together transversely to the longitudinal direction, and 5) a respective vertical adjustment drive for independent vertical adjustment of each pair of lifting rollers with respect to the tool frame, wherein a spacing-apart motion of the two lifting rollers of each pair by the transverse adjustment drive is coupled to an automatic actuation of the associated vertical adjustment drive for lowering the pair of lifting rollers with respect to the tool frame.

2. The machine of claim 1, wherein an actuation of the transverse adjustment drive for squeezing together both lifting rollers of a pair is coupled to an automatic actuation of the associated vertical adjustment drive for lifting the pair of lifting rollers with respect to the tool frame.

3. The machine of claim 1, and further comprising roller carriers vertically adjustably connected to the tool frame, wherein the two lifting rollers of each pair are jointly mounted on a respective one of the roller carriers.

4. The machine of claim 3, wherein each roller carrier has the shape of a hydraulic cylinder forming the vertical adjustment drive, and further comprising a respective vertical guide column connected to the tool frame for vertically adjustably supporting each roller carrier.

5. The machine of claim 1, and further comprising a sliding beam for common support of all pairs of lifting rollers, the sliding beam being mounted on the tool frame for displacement transversely to the longitudinal direction.

6. The machine of claim 5, and further comprising a displacement drive connected to the tool frame and the sliding beam.

7. The machine of claim 1, and further comprising a linkage connecting the tool frame to the machine frame for pivoting about horizontal pivot axes extending transversely to the longitudinal direction, the linkage being shaped approximately like a parallelogram.

8. The machine of claim 7, wherein the linkage is composed of two tie rods, arranged in a common plane and spaced from one another transversely to the longitudinal direction, and a towing rod arranged underneath said plane and extending parallel thereto.

9. The machine of claim 8, wherein the towing rod is designed to be telescopically extensible, and further comprising a length adjustment drive connected to the towing rod.

10. The machine of claim 8, wherein the tie rods are articulatedly fastened to the tool frame at a hinging point formed by a horizontal shaft extending transversely to the longitudinal direction.

11. The machine of claim 10, wherein the lifting drives of the track lifting unit are articulatedly fastened at their one end to the machine frame and at their other end to the horizontal shaft in each case immediately next to one of the tie rods.

12. The machine of claim 8, wherein the two tie rods are arranged in mirror symmetry with respect to a vertical plane of symmetry extending in the longitudinal direction and are positioned to extend at an acute angle to one another.

13. The machine of claim 1, wherein a lowering of the pair of lifting rollers with respect to the tool frame is accompanied by a vertical adjustment of the transverse drive in relation to the tool frame, as lifting rollers move apart.

* * * * *